United States Patent [19]

Rhodes

[11] 3,998,177

[45] Dec. 21, 1976

[54] OUTBOARD MOTOR

[76] Inventor: William A. Rhodes, 4421 N. 13th Place, Phoenix, Ariz. 85014

[22] Filed: Feb. 24, 1975

[21] Appl. No.: 552,413

[52] U.S. Cl. ..... 115/18 E; 115/12 A

[51] Int. Cl.[2] ..... B63H 21/26; B63H 1/04

[58] Field of Search ..... 115/12 R, 12 A, 14, 115/18 E; 60/221, 230

[56] References Cited

UNITED STATES PATENTS

| | | | |
|---|---|---|---|
| 2,943,593 | 7/1960 | Megert | 115/12 A |
| 3,283,737 | 11/1966 | Gongwer | 115/12 |
| 3,295,490 | 1/1967 | Hiatt | 60/221 |
| 3,624,738 | 11/1971 | Gill | 115/17 |

*Primary Examiner*—George E. A. Halvosa
*Assistant Examiner*—Gregory W. O'Connor

[57] ABSTRACT

A trolling motor has a housing provided with a longitudinal axis and wherein a propeller is mounted to rotate about said longitudinal axis; the housing having inlet and outlet openings vertically spaced apart and wherein the propeller is disposed therebetween; inlet and outlet guide vanes of substantially L-shaped configuration disposed in an array diagonally related to the inlet and in a diagonal array related to the outlet. The trolling motor is provided with a mount on which is it is rotatable on its longitudinal axis, whereby rotation of said fluid trolling motor about its longitudinal axis provides for reversing of thrust when operated as an outboard motor.

1 Claim, 3 Drawing Figures

OUTBOARD MOTOR

BACKGROUND OF THE INVENTION

Various boat motors and trolling motors have been used with propellers which are driven by a motor and a drive shaft, the conventional system utilizing a drive shaft with miter gears translating rotary motion from a vertical axis to a horizontal axis and wherein reversing gears are used to reverse the propeller, all of which provides for a very complicated mechanism. Additionally, some trolling motors for boats have been utilized wherein a small electric motor is used to drive the propeller and various means such as flexible shafts and gearing have been used to dispose the output axis of the propeller on a horizontal axis while the drive from the motor extends through a vertical axis. Additionally, these small electric motors have resorted to reversing switches for reversing the rotation of the propeller in order to reverse thrust when used in the water.

SUMMARY OF THE INVENTION

The present invention relates to a very simple fluid propulsion means which may be used as a boat trolling motor. This propulsion means comprises a housing having a longitudinal axis and also provided with inlet and outlet openings opposed to each other and spaced longitudinally of the longitudinal axis; a propeller being mounted between the inlet and outlet in the housing and having a rotary axis substantially aligned with the longitudinal axis of the housing. Additionally, the propulsion means being provided with turning vanes disposed in the housing adajcent the inlet and outlet, the turning vanes being generally L-shaped and having apex portions, these vanes being in an array wherein several of the vanes at their apex portions are generally spaced apart and aligned with each other in a diagonal direction relative to said longitudinal axis and to an axis of the inlet and outlet which is disposed generally at right angles to the longitudinal axis. The frame of the propulsion means coupled to said housing is rotatable about said longitudinal axis of said housing so that the inlet and outlet of the housing may be reversed relative to each other to provide for reverse thrust.

In the use of the present flid propulsion means as a trolling motor the inlet is disposed above the outlet and faces in a forward direction at a forward side of the housing while the outlet is below the inlet and below the propeller so as to provide thrust in a rearward direction from the rearward side of the housing. When it is desired to reverse the thrust, the housing is rotated about its longitudinal axis and the inlet above the propeller receives water and the outlet directs it in a forward direction so as to provide reverse thrust for a boat or other vehicle on which the fluid propulsion means is mounted.

The fluid propulsion means of the present invention only has a drive motor and a propeller in the housing without resorting to any means for making mechanical transitions from a generally longitudinal axis to an axis at right angles thereto, thereby reducing the complexity of the propulsion means and the relative maintenance and cost thereof. Additionally, the rotatable relationship of the housing of the invention about its longitudinal axis provides for the rotatable reversing deposition of the inlet and outlet to reverse thrust of the fluid propulsion means, all of which provides for a very simple construction which is very simple in operation and very efficient. Additionally, the initial cost of such a fluid propulsion means is nominal compared to that of conventional devices such as conventional trolling motors operated by a small electric motor or by conventional two cycle or four cycle gasoline engines.

Accordingly, it is an object of the invention to provide a very simple, economical and efficient fluid propulsion means which may be used as a boat trolling motor or for other purposes as desired.

Another object of the invention is to provide a novel combination of a housing with a propeller therein wherein an inlet is normally above the propeller and an outlet is normally below the propeller and the inlet and outlet being opposed relative to each other about the longitudinal axis of the housing and wherein an array of turning vanes is disposed in the housing adjacent the inlet and another array of turning vanes is disposed in the housing adjacent the outlet so as to provide efficient transitory movement of fluids to the housing from the inlet to the outlet to efficiently translate power imparted to the fliud by the propeller in the housing.

Another object of the invention is to provide a novel configuration and assembly of arrays of turning vanes adjacent the inlet and outlet of the propeller housing, each array comprising a plurality of turning vanes of generally L-shaped configuration and having apex portions being spaced apart in a direction diagonally relative to the axis of the inlet which is at right angles to the longitudinal axis of the housing and of the rotating propeller.

Another object of the invention is to provide a fluid propulsion means particularly adapted for trolling motors in relation to the propulsion of boats wherein no angular transition drive mechanism is required nor is there any reversing gear mechanism or switch mechanism required for reversing thrust of the motor, such being accomplished by simple rotation of the motor around its longitudinal axis so as to change the direction of the inlet relative to the outlet.

Another object of the invention is to provide a very simple lightweight trolling motor having a minimum of maintenance and functional problems.

Further objects and advantages of the invention may be apparent from the following specifications, appended claims and accompanying drawings.

BRIEF DESCRIPTION OF THE DRAWINGS

FIG. 1 further showing by broken lines a reverse position of the inlet and outlet of the thrust creating means of the invention;

DESCRIPTION OF THE PREFERRED EMBODIMENTS

Figure 1:
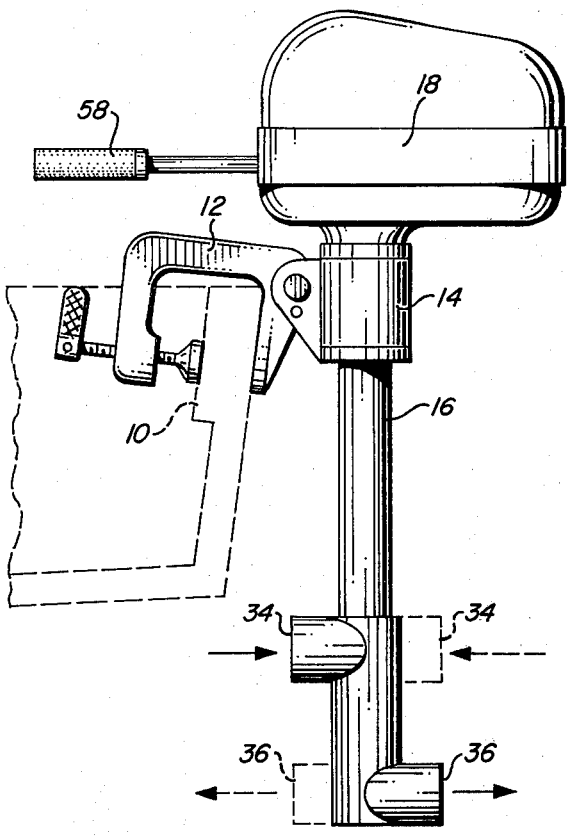
FIG. 1 is a side elevational view of a fluid propulsion means in accordance with the present invention and shown in the configuration of a trolling motor and shown coupled to a boat which is illustrated in broken lines.
Figure 3:
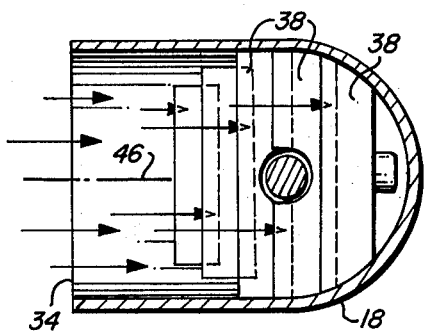
FIG. 3 is a fragmentary plan sectional view taken from the line 3—3 of FIG. 2.

As shown in FIG. 1 of the drawings, the fluid propulsion means of the invention may be used in the form of a conventional outboard motor for use as a trolling motor and for use in attachment with the stern of a boat which is represented by broken lines 10 in FIG. 1 of the drawings.

A substantially conventional means for mounting the motor is designated 12 and it carries a pivot bearing housing 14 in which a hollow shaft 16 is rotatably mounted. This hollow shaft 16 projects downwardly from a motor housing 18 which may contain a conventional electric motor and a battery or it may contain a conventional two cycle or four cycle internal combustion engine for driving the propeller shaft as will be hereinafter described in detail.

Figure 2:
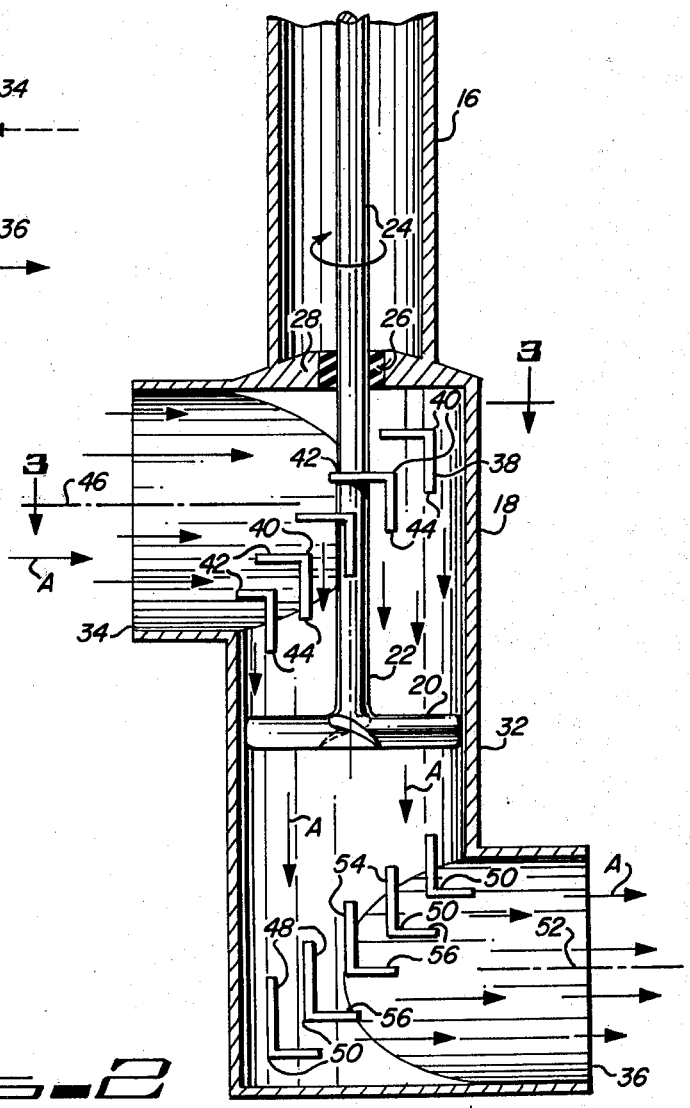
FIG. 2 is an enlarged vertical axial view of the fluid propulsion means of the invention illustrating the housing and propeller means thereof.

Referring to FIG. 2 of the drawings, it will be seen that the shaft 16 suspends a fluid conducting housing 18 in which a propeller 20 is rotatably mounted about an axis 22 which constitutes a longitudinal axis of the housing 18 and also the rotary axis for the propeller which is mounted on a shaft 24 extending upwardly through the hollow tubular member 16 to a suitable motor in the housing 18 as hereinbefore described.

The shaft 24 passes through a liquid seal 26 in the normally upper end 28 of the housing 18 and this housing 18 is provided with a forward portion 30 and a rearward portion 32. Disposed in the forward portion of the housing 30 is a fluid inlet 34 and disposed in the rearward portion of the housing is a fluid outlet 36.

The fluid inlet 34 is normally disposed above the outlet 36 and spaced vertically relative thereto and the propeller 20 is mounted between the inlet 34 and the outlet 36.

The propeller rotates in a direction so as to induce propulsion of fluid in directions as indicated by the arrows A in FIG. 2 of the drawings, whereby water or other fluid may be induced to flow into the outlet 34 and axially downward through the housing 18 and outwardly through the outlet 36, all as indicated by arrows in FIG. 2 of the drawings.

In the housing 18 adjacent to the inlet 34 is an array of vanes generally designated 38. Each vane is generally L-shaped and is provided with an apex portion 40 and a pair of flange portions 42 and 44 which are disposed at substantially right angles with each other. The flange portions 42 are generally parallel with a flow axis 46 of the inlet 34 while the flanges 44 are generally parallel with the longitudinal axis 22 of the housing 18. It will be seen that the apex portions 40 of the vanes 38 are generally aligned in a diagonal direction relative to the axis 46 and the axis 22 such that the diagonal alignment is substantially at 45 degrees relative to both of the axes 22 and 46.

Similar vanes 48 are disposed in the housing 18 adjacent the outlet 36 and these vanes are arranged in a spaced stepped array. They are generally L-shaped in configuration and provided with apex portions 50 which are aligned generally with each other in a direction diagonal to an outlet axis 52 of the outlet 36 and also in a diagonal direction relative to the longitudinal axis 22 of the housing 18. Thus the apex portions 50 are aligned with each other in a direction generally at 45 degrees to the axes 22 and 52 of the housing 18 and the outlet 52.

The vanes 48 are provided with flange portions 54 which are disposed generally parallel to the longitudinal axis 22 of the housing 18 and these vanes 48 are also provided with flanges 56 which are aligned with and substantially parallel to the outlet axis 52.

It will be seen that with rotation of the propeller 20 by the shaft 24 as driven by any suitable motor the inlet 34 when immersed in fluid such as water will cause water to pass into the housing 18 and as the propeller 20 rotates it creates flow in the directions as indicated by the arrows A through the inlet 34 and outwardly through the outlet 36.

The L-shaped vanes 38 and 54 provide flow directors making angular transitions from the inlet 34 to the longitudinal axis 22 of the housing and from the longitudinal axis 22 to the outlet 36.

The L-shaped form of the vanes 38 tend to maintain a full cross sectional flow from the inlet 34 into the housing 18 and from the housing 18 into the outlet 36 such as to prevent cavitation and to provide maximum flow efficiency of the fluid as induced by the propeller 20. It will, therefore, be appreciated that the propulsion means hereinbefore described provides for generally horizontal intake and outlet flow thereby taking advantage of both the suction and expulsion provided by the propeller 20 to create thrust. Actually the thrust is developed on the L-shaped vanes while the motor is mounted well above the fluid in an instance where the propulsion means of the invention is used as an outboard motor.

Since mechanical friction and turbulence defeat most battery driven systems due to the use of miter gears or flexible shafts the present invention reduces such losses to a minimum whereby one additional loose sleeve bearing such as nylon or the like is necessary in addition to the motor bearings and the right angle flow vanes change the direction of water flow with the least turbulence and cavitation losses.

It will be understood that a handle 58 as shown in FIG. 1 in connection with the motor housing 18 may be used for steering the boat to which the motor is connected simply by rotating the hollow shaft 16 in the bearing 14 about a substantially vertical axis which is the longitudinal axis 22 of the housing 18 and thus the inlet 34 and the outlet 36 may be concurrently and angularly shifted to different directions for steering.

Additionally, it will be understood that rotation of the hollow tubular member 16 substantially 180 degrees from that shown by solid lines in FIG. 1 disposes the inlet 34 rearwardly and the outlet 36 forwardly to provide reverse thrust of the fluid propulsion means, this being very desirable in a boat trolling motor for example and thus reduces the complexity as compared to many trolling motors which have reversing switches or reversing gears depending upon their structural arrangements, however, such simplicity as provided by the present invention reduces the necessity of utilizing reversing switches on electric motors and also using miter gears or other transitory mechanism for converting or relating the normal vertical rotary movement of a shaft such as the shaft 24 to a propeller having a rotary axis disposed in a direction comparable to the axis 52 of the outlet 36. It will be appreciated that the entire assembly of the present invention is very simple, straight forward, efficient, light in weight with a minimum initial cost and minimum maintenance problems.

It will be appreciated by those skilled in the art that various modifications may be made without departing from the spirit of the present invention.

I claim:

1. In a trolling motor: a frame, a motor mounted on said frame; means for mounting said motor on said frame; a motor driven shaft disposed to be rotatably driven by said motor; a fluid conducting housing supported by said means for mounting on said frame; said shaft extending into said housing; a propeller fixed to said shaft and disposed in said housing; said housing having a generally vertical longitudinal axis; said housing having an inlet normally disposed generally at right angles to said generally vertical longitudinal axis; said housing having an outlet spaced axially along said longitudinal axis from said inlet; said inlet disposed above said outlet; said outlet having an axis disposed generally at right angles to said generally vertical longitudinal axis; said inlet and outlet openings having respective fluid flow axes which are generally at right angles to said generally vertical longitudinal axis; said inlet being opposed to said outlet; said inlet and outlet being substantially 180° apart relative to said generally vertical longitudinal axis of said fluid conducting housing; said inlet and outlet spaced from each other; said propeller disposed between said inlet and said outlet and having a rotary axis substantially parallel with said generally vertical longitudinal axis; said inlet and outlet disposed to be immersed in water; vanes are disposed in said housing adjacent said inlet and outlet openings and adapted to turn flow substantially 90° from said inlet to the vertical axis of said housing and from the vertical axis to the outlet of said housing; means for mounting said frame, said last mentioned means adapted to mount said frame on a boat; said longitudinal axis disposed generally in a vertical direction normally during operation; said inlet and said outlet being disposed generally in a horizontal direction when in operation; said vanes are L-shaped in cross section and are arranged in a stepped array relative to each other and said array being disposed diagonally relative to the axes of said inlet and outlet and said longitudinal axis; said means for mounting said frame having a rotary bearing means adapted to permit 360° rotation of said trolling motor relative to said mounting means whereby 180° rotation of said trolling motor relative to said mounting means provides for reversal of operation of said trolling motor, thereby creating thrust in opposite directions when rotated 180° about said longitudinal axis.

* * * * *